US006151734A

United States Patent [19]

Lawrie

[11] Patent Number: 6,151,734

[45] Date of Patent: Nov. 28, 2000

[54] HEAD SUPPORT APPARATUS

[76] Inventor: William H. Lawrie, 785 Orchard St., Lewisburg, Tenn. 37091

[21] Appl. No.: 09/010,345

[22] Filed: Jan. 21, 1998

[51] Int. Cl.[7] ..... A47C 20/12

[52] U.S. Cl. ..... 5/640; 5/638; 5/643; 5/659; 5/622

[58] Field of Search ..... 5/636, 638, 640, 5/643, 658, 659, 661, 622; 297/408, 409; 108/49

[56] References Cited

U.S. PATENT DOCUMENTS

| | | | |
|---|---|---|---|
| 2,169,117 | 8/1939 | Utermohlen | 5/636 |
| 2,239,003 | 4/1941 | Jones | 5/638 |
| 2,551,727 | 5/1951 | Costello | 5/638 |
| 3,114,527 | 12/1963 | Demarest | 5/640 |
| 4,321,718 | 3/1982 | Chern | 5/640 |
| 4,333,638 | 6/1982 | Gillotti | 5/638 |
| 4,504,050 | 3/1985 | Osborne | 269/328 |
| 4,752,064 | 6/1988 | Voss | 269/328 |
| 4,757,983 | 7/1988 | Ray et al. | 269/328 |
| 4,881,728 | 11/1989 | Hunter | 269/328 |
| 4,943,041 | 7/1990 | Romein | 269/322 |
| 5,177,823 | 1/1993 | Riach | 5/636 |
| 5,337,429 | 8/1994 | Tucker | 5/640 |
| 5,347,668 | 9/1994 | Manning | 5/640 |
| 5,546,619 | 8/1996 | Braun | 5/638 |
| 5,608,935 | 3/1997 | Warfield | 5/639 |

OTHER PUBLICATIONS

Ex. 1—1 pg brochure for Golden Ratio Woodworks.

Ex. 2—2 pg brochure for Strongelite Inc., Cottage Grove, OR 97424.

Ex. 3—1 pg brochure for Face Rest, Oakworks.

Ex. 4—2 pg brochure for Blue Ridge Tables, Corinth, Mississippi 38834.

Ex. 5—1 pg brochure for Living Earth Crafts, Santa Rosa, CA 95407.

Ex. 6—1 pg brochure for Earthlite, Vista, CA 92083.

Ex. 7—1 pg brochure for Living Earth Crafts.

Ex. 8—2 pg brochure for Custom Craftworks, Eugene, OR 97402.

Ex. 9—2 pg brochure for Body Support Systems, Inc., Ashland, OR 97520.

Ex. 10—1 pg brochure for Tatum Lignt.

*Primary Examiner*—Lynne H. Browne
*Assistant Examiner*—Fredrick Conley
*Attorney, Agent, or Firm*—Waddey & Patterson; Edward D. Lanquist, Jr.

[57] ABSTRACT

A head support apparatus useful for converting a conventional bedding mattress set into a massage table. The apparatus comprises a base having a pair of upright legs supporting a face plate. A head or face cushion is attached to the face plate. The face plate and the cushion are configured to enable unrestricted airflow to the nose and mouth of a person whose head is supported thereon, particularly in a face-down position. The legs are affixed to a front end of the base, and the face plate is cantilevered beyond the base plate enabling the base plate to be inserted between two support surfaces, including a mattress and box spring, such that the face plate is positioned immediately adjacent an edge of the support surfaces. The legs are preferably configured to enable vertical height adjustment of the apparatus.

14 Claims, 6 Drawing Sheets

HEAD SUPPORT APPARATUS

BACKGROUND OF THE INVENTION

The present invention relates generally to head rests and head support devices, and more particularly to such devices configured for use during in-home therapeutic massage performed on any conventional bedding mattress.

Massage therapy has become a popular means for relieving stress and for treating various ailments. Further, massage therapy often comprises an important aspect of patient rehabilitation for injuries. Thus, it will be appreciated by those skilled in the art that it is convenient and desirable to have an apparatus for supporting the head during massage therapy, particularly when the patient is lying face down. To this end, there have been several attempts to devise head support devices that are attachable to a massage or operating table.

One such attempt was disclosed in U.S. Pat. No. 4,752,064, issued to Voss, which is incorporated by reference as if fully set forth herein. The Voss disclosure is directed to a therapeutic head support comprising pillow having a T-shaped void therein conforming to the contours of the face. One or more channels may be cut in the pillow to provide airways or allow insertion of a tube into the patient's mouth. The device further includes a support structure comprising a plate having support rods that are welded to clamps. Accordingly, the clamps may be removably secured to the end of an operating table. The plate includes a cutout corresponding to the void formed in the pillow.

U.S. Pat. No. 4,881,728, issued to Hunter, is directed to an adjustable head support attachment for a therapy table. The device comprises an elongated telescoping shaft having a base on each end thereof for attachment to opposite sides of the apron of a table, a pair of arms secured together in spaced parallel relation and rotatably mounted at one end on the shaft, a generally planar head support member mounted on the outer ends of said arms, a one-way cam brake on one of said arms for stopping rotation thereof relative to said shaft in one direction for selectively holding said head support member in selected support positions, and a brake release for selectively releasing said brake for enabling rotation in said one direction.

U.S. Pat. No. 4,943,041, issued to Romein, is directed to a light-weight folding massage table that includes a face rest. The face rest is supported by a cloth surface, the outer perimeter of which is inserted on a U-shaped tube. Both sides of the U-shaped tube are rotatably attached to an S-shaped head support tube. The other end of the head support tube is upwardly notched and insertable into grommets at the end of the massage table. A spring and tab means holds the head support tube in place enabling the headrest to be readily raised or lowered.

U.S. Pat. No. 4,333,638, issued to Gillotti, is directed to a massage and therapeutic body work table. The table includes a face rest comprising three cushions mounted on a flat plate. The plate includes rods which extend beyond the plate and are insertable through openings in the peripheral border flanges at one end of the table, thus providing an extension off the end of the table.

U.S. Pat. No. 4,504,050, issued to Osborne, is directed to a head support comprising a base, at least one flange extending from the base, a faceplate connected to the flange defining a support for cooperating with the face of the subject such that a forehead portion of the subject is supported at a first end portion of the faceplate and a chin portion of the subject is supported at a second end portion of the faceplate while the subject is in the prone position. A mechanism for adjusting the position of the faceplate with respect to the flange and for controlling the degree of extension of the subject is provided.

U.S. Pat. No. 4,757,983, issued to Ray et al., is directed to a head and chin rest for face-down operations. The device comprises a frame including cushioned forehead and chin supports. The frame is pivotal to raise or lower the chin support relative to the forehead support. The forehead and chin supports are spaced to make the patient's face almost fully accessible, and that spacing is adjustable to allow for heads of various sizes. The base preferably includes a rocker base, thus permitting the patient to pivot the head and chin rest with his head to the most comfortable attitude.

U.S. Pat. No. 5,546,619, issued to Braun, is directed to a head supporting device for use while suntanning. The device comprises a horseshoe-shaped head support having a first opened end, a second closed end, an inner periphery, an outer periphery, an upper surface, a lower surface, a first side and a second side. The inner periphery is adapted to support a user's head. First and second sets of legs are provided for supporting the head support. Each leg is pivotally connected to the lower surface of the head support, and is pivotal between a first position adjacent the lower surface of the head support and a second position perpendicular to the lower surface of the head support.

U.S. Pat. No. 5,608,935, issued to Warfield, is directed to a ground supported head rest comprising a base frame positionable on a ground surface, and an upper frame supported by the base frame by a plurality of stanchions. A perimeter pad extends about the upper frame for engaging a human head. The upper frame is substantially oval in shape to accommodate a human head in both prone and supine positions.

In addition, there are many commercially available head and face rests which are incorporated into or attachable to massage tables and chairs, such as those manufactured and/or sold by Golden Ratio Woodworks, Stronglite Incorporated, Oakworks, Blue Ridge Tables, Living Earth Crafts, Earthlite, Tatum Light, Custom Craftworks, Body Support Systems, and other companies.

Most of the aforementioned devices are configured for attachment to a massage or operating table or to be supported on a ground surface. What is needed then, is a portable head rest or support apparatus that may be used in conjunction with conventional bedding mattresses to eliminate the need for a special massage table or chair.

SUMMARY OF THE INVENTION

The present invention comprises an adjustable head support apparatus for use during therapeutic massage. The apparatus is particularly designed for home use, and provides an alternative to specially designed massage tables by converting a conventional bedding mattress into a massage table. Thus, the in-home novice who does not own or have access to a massage table can perform massages using the apparatus of the present invention. The apparatus may also be used by professional massage therapists who find massage tables bulky to transport.

The head support of the present invention is also useful for in-home rehabilitation for various injuries, such as injuries associated with the head, neck, eyes, nose, sinuses, and the like, which require a patient to lie in a face-down position for prolonged periods of time.

The apparatus includes a frame comprising a base plate having a pair of upright legs extending therefrom, and a face plate supported by the legs. The apparatus further includes cushion means mounted to the face plate for directly supporting the head or face of a patient.

In the preferred embodiment, the legs are configured to enable vertical height adjustment of the head support. Accordingly, each of the legs further comprises a pair of telescoping tubular columns. One column extends upwardly from a front portion of the base plate, and a complementary column extends from a lower side of the face plate.

Each of the columns extending from the base plate includes a plurality of spaced apart bores configured to receive pin means. Further, each of the columns of the face plate includes a bore positioned at a distal end thereof. Accordingly, the bores formed in the base legs and the bores formed in the face plate legs may be aligned to achieve the desired height. A pin or bolt may be inserted into the aligned bores to retain the head support apparatus in any of a plurality of user-selectable positions.

The face plate comprises a horseshoe-shaped plate supported by the legs. The cushion means is detachably mounted to the face plate.

The frame may be constructed of any rigid material, including metals, plastics and composites. The cushion means preferably comprises a pillow or cushion constructed of closed-cell polyurethane contained within a cover constructed of any suitable material, including without limitation, vinyl, cloth and the like.

It is an object of the present invention to provide a head support apparatus for use during massage therapy.

It is another object of the present invention to provide a head support apparatus comprising a base, a face plate, cushion means and adjustment means for enabling vertical adjustment of the apparatus.

It is another object of the present invention to provide a head support apparatus that is capable of being used in conjunction with conventional bedding mattresses.

It is another object of the present invention to provide a head support apparatus that enables unrestricted air flow to the nose and mouth when a patient or massage recipient is in a "face down" position.

It is yet another object of the present invention to provide a head support apparatus that provides a superior ergonomic position for the head, neck and shoulders for a patient positioned on a conventional bedding mattress during therapeutic massage.

These and other objects, features and advantages shall become apparent after consideration of the description and drawings set forth herein. All such objects, features and advantages are contemplated to be within the scope of the present invention even though not specifically set forth herein.

DESCRIPTION OF THE PREFERRED EMBODIMENT

Figure 1:
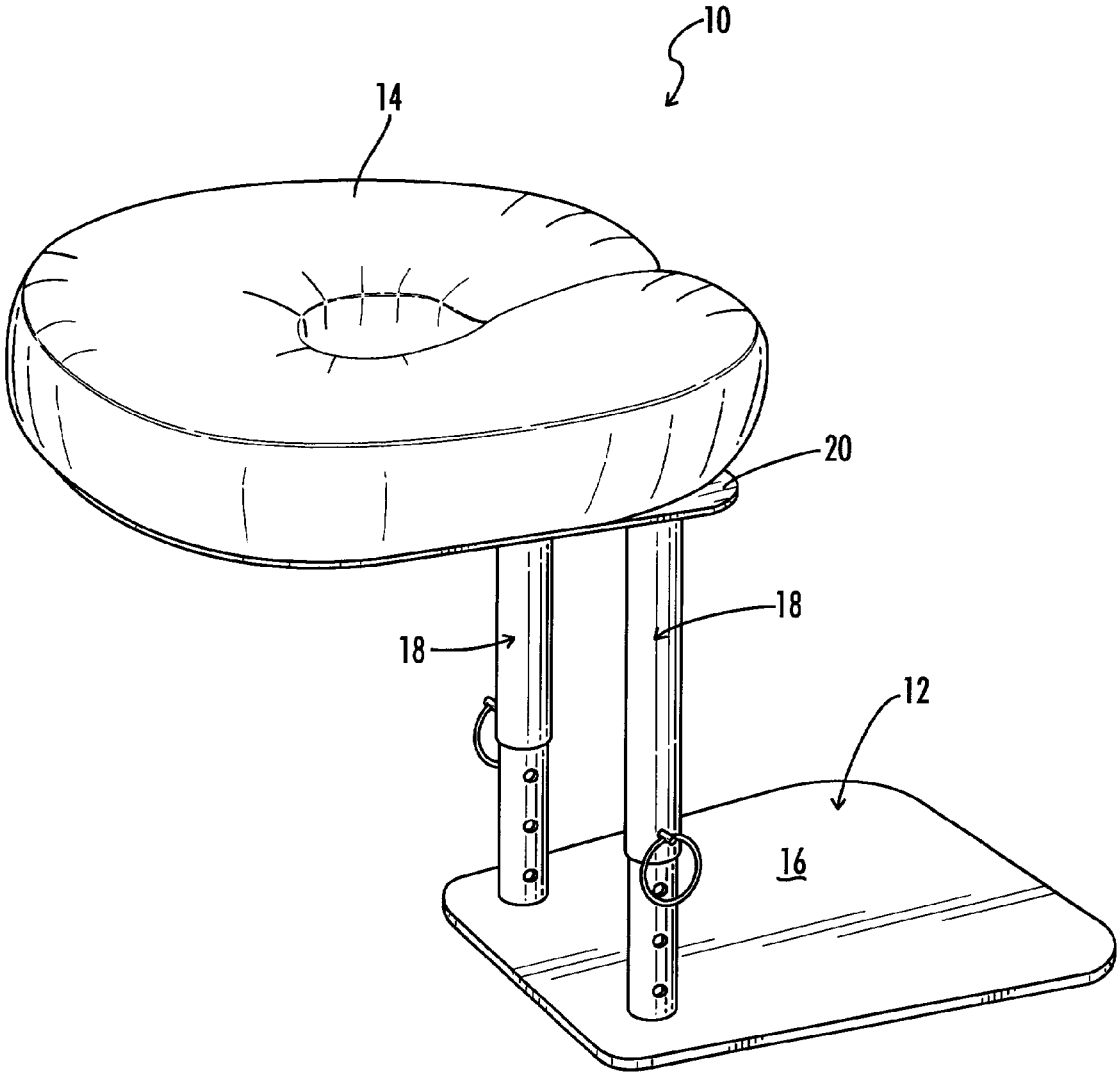
FIG. 1 is a perspective view of an embodiment of the present invention.

An embodiment of the present invention is designated generally by the reference numeral 10 in FIG. 1. Head support 10 is configured to convert a conventional mattress set 11 into a massage table by providing a means for supporting a person's head when lying in either a supine or prone position. The head support 10 of the present invention is configured to enable unrestricted airflow to the nose and mouth while a person is lying prone (face down) on a conventional mattress 11. The head support 10 may also be used for in-home rehabilitation for injuries that require a patient to lie in a face-down position for prolonged periods of time.

Figure 6:
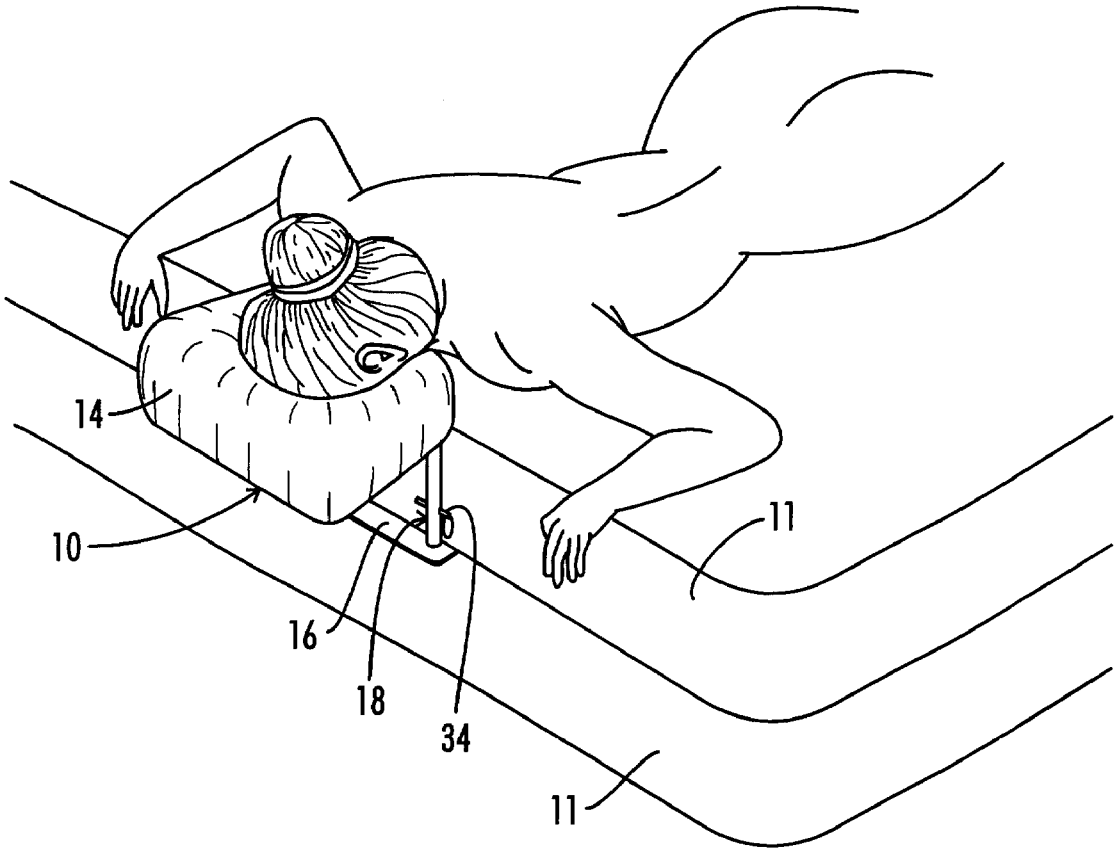
FIG. 6 is a perspective view of the present invention operatively installed on a conventional bedding mattress.

Accordingly, head support 10 comprises a frame 12 supporting cushion means 14. The frame 12 includes a base plate 16, at least one support leg 18 and a face plate or support 20. In the preferred embodiment, the base plate 16 comprises a planar body having a front portion 22 and a rear portion 24. The base plate 16 16 may be of any desired shape, such as rectangular, oval, trapezoidal and the like. The leg(s) 18 are affixed to the front portion 22 of the base plate 16 to enable the base plate 16 to be inserted between the mattress and box spring of a conventional bedding mattress set (see FIG. 6).

In the preferred embodiment, the head support 10 of the present invention includes a pair of support legs 18; however, the head support 10 may only include one such leg 18, or may include three or more legs 18. The legs 18 are preferably configured to enable vertical height adjustment of the head support 10. Thus, in the preferred embodiment, each leg 18 further comprises a pair of tubular columns 26 and 28. One of the columns has a diameter that is smaller than the diameter of the other column to enable the smaller diameter column to be slidably received within the larger diameter column for telescoping adjustment. One column 26 of the pair is affixed to and extends vertically upward from the base plate 16, and is hereinafter referred to as a "base leg". A complementary column 28 is affixed to and extends vertically downward from a lower side of the face plate 20, and is hereinafter referred to as a "face plate leg". Accordingly, the face plate legs 28 are slidably insertable into the base legs 26, or, alternatively, the base legs 26 are slidably insertable into the face plate legs 28.

Figure 2:
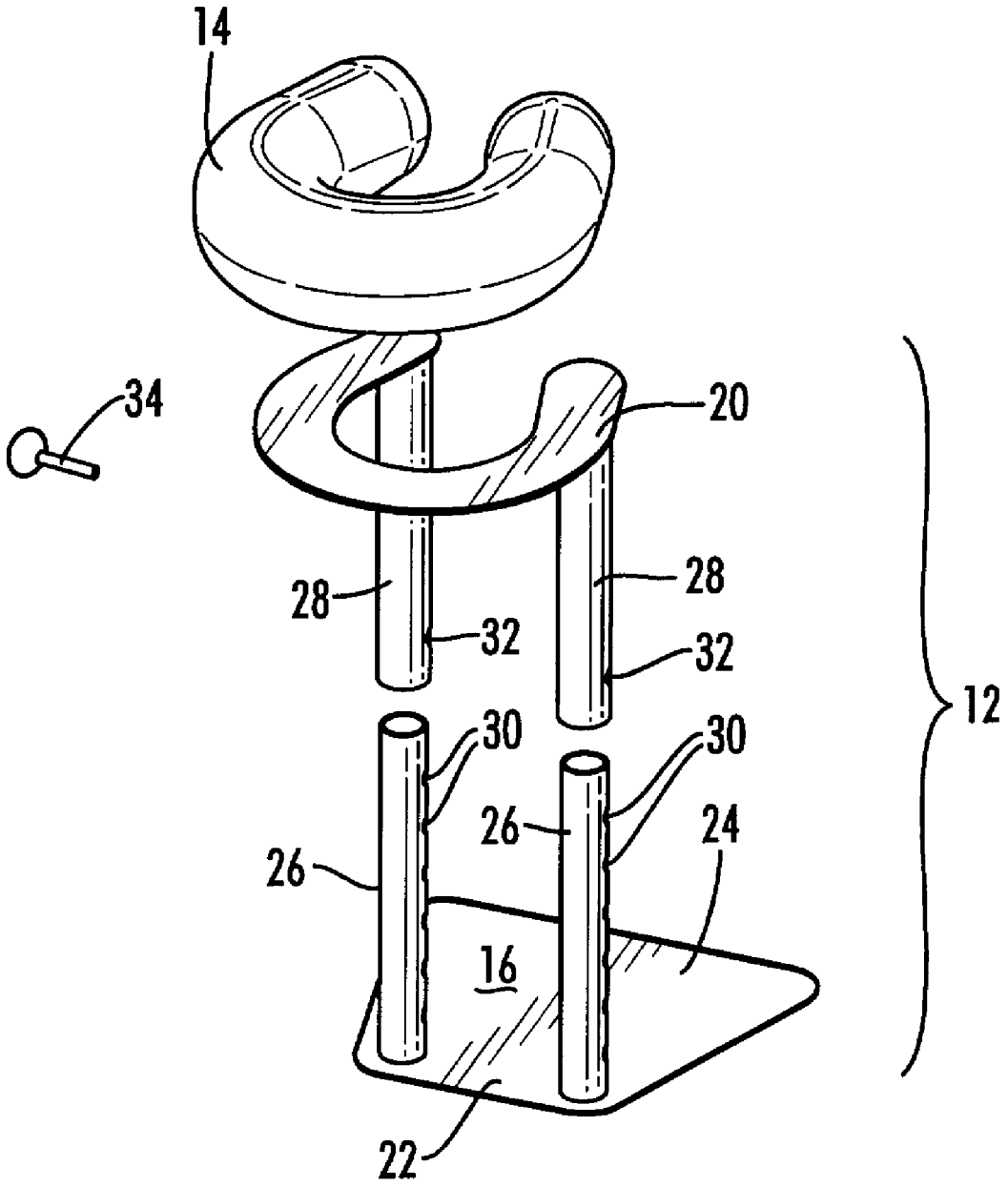
FIG. 2 is an exploded perspective view of the embodiment of the present invention shown in FIG. 1.
Figure 4:
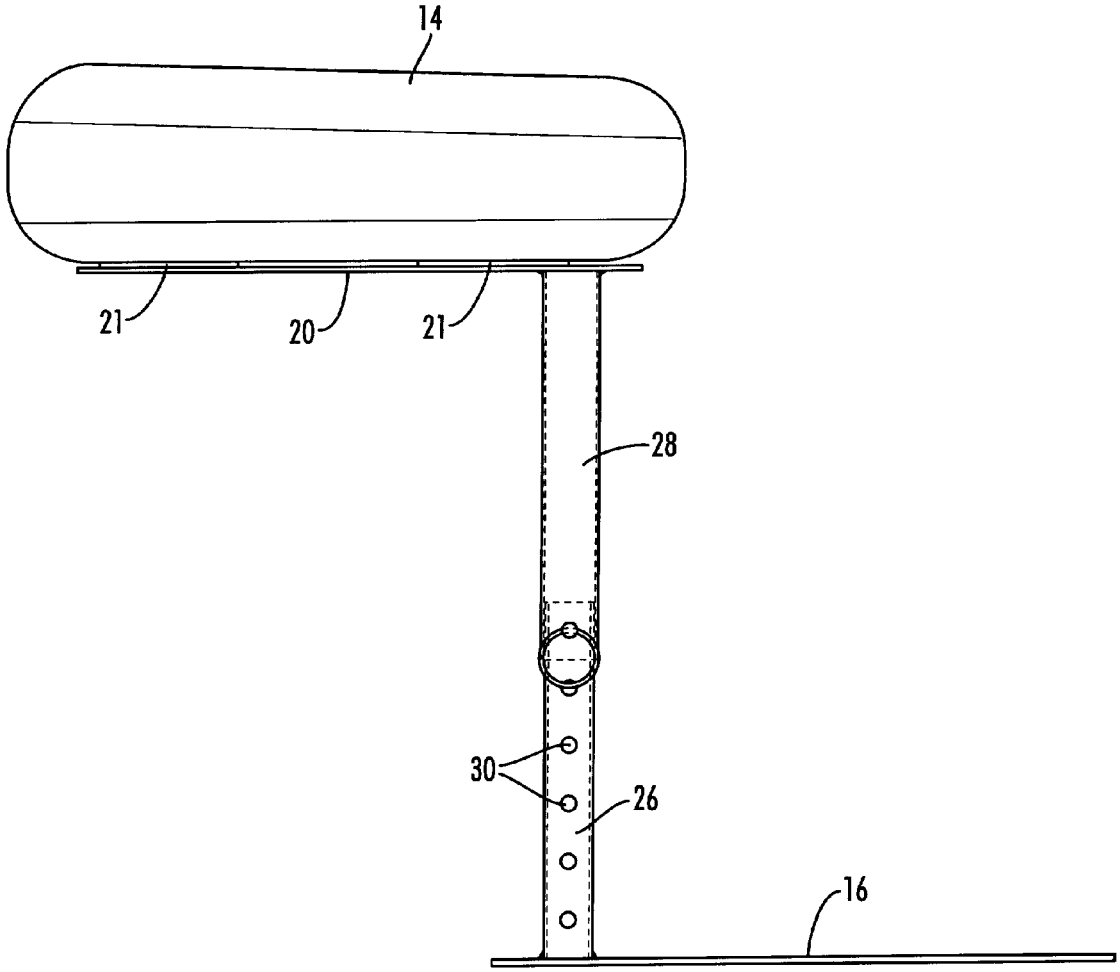
FIG. 4 is a side view of the embodiment of the invention shown in FIG. 1.
Figure 5:
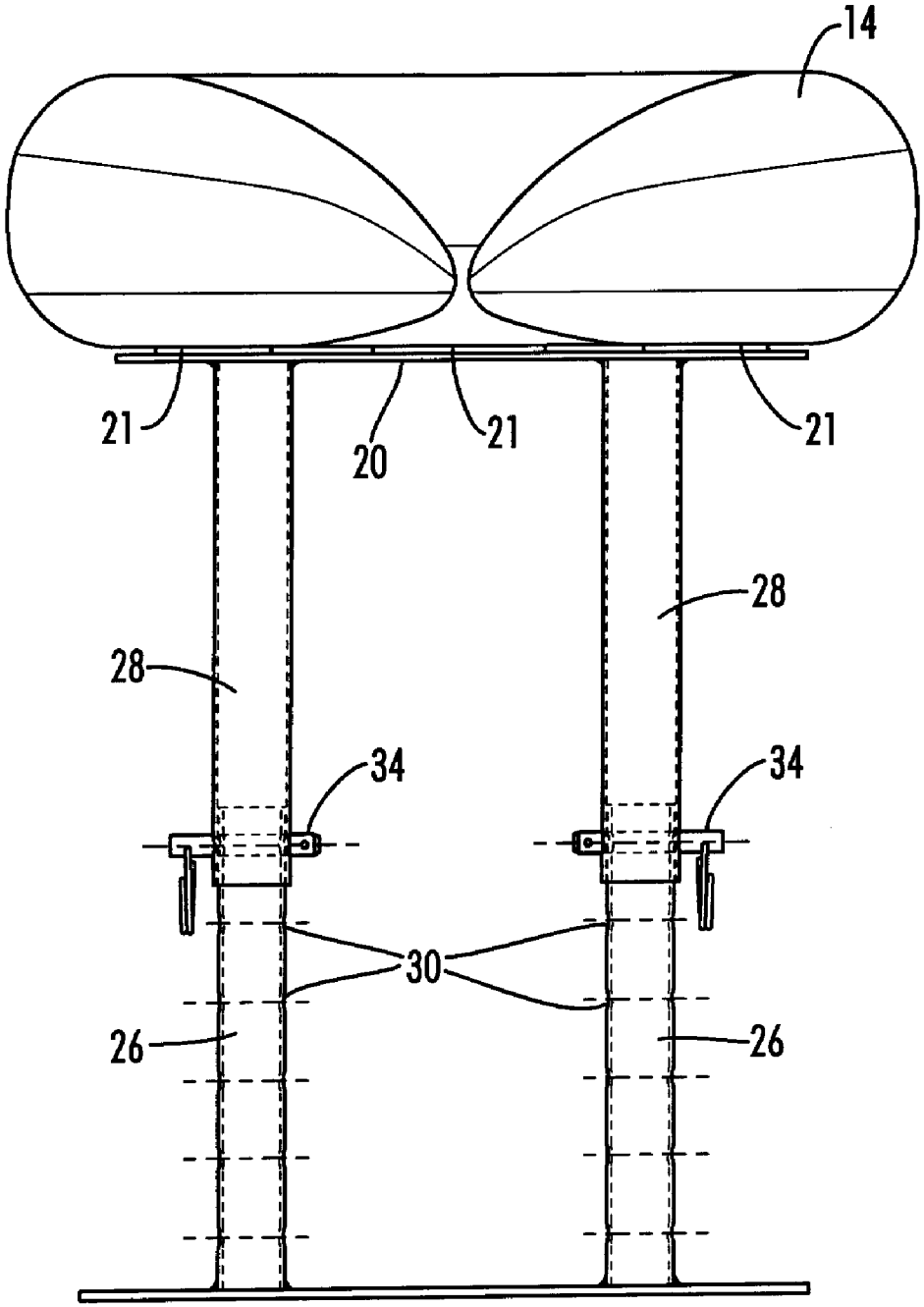
FIG. 5 is a front end view of the embodiment of the invention shown in FIG. 1.

With reference to FIGS. 2, 4 and 5, the base legs 26 include a plurality of spaced apart pairs of opposing bores 30 and the face plate legs 28 include a pair of opposing bores 32 formed at distal ends thereof (or vice versa). The bores 30 and 32 are configured to receive pin means 34 for retaining the legs 18 at a predetermined height. Accordingly, when the face plate legs 28 (or base legs 26) are inserted into the base legs 26 (or face plate legs 28), the bores 32 formed in the face plate legs 28 (or base legs 26) may be aligned with any of the plurality of bores 30 formed in the base legs 26 (or face plate legs 28) to achieve the desired vertical height. Pin means 34 may then be inserted therethrough to prevent vertical movement of the legs 18 (see FIGS. 1, 4 and 5).

Alternatively, the larger diameter column may include a plurality of spaced apart bores configured to receive button means (not shown) attached to the smaller diameter column. The button means is biased is protrude from any of the plurality of bores when aligned therewith to anchor the column at a user-selectable height. The button means may be depressed to enable the slidable adjustment of the columns.

With reference to FIG. 2, the face plate 20 preferably comprises a horseshoe-shaped plate; however, it is contemplated that the face plate 20 may be configured in any suitable shape, such as U-shaped, circular and the like so long as the central portion is open to enable an unrestricted flow of air to the nose and mouth of a person lying face down. The face plate 20 includes an upper side 36, a lower side 38 and spaced apart ends 40 and 42. In the preferred embodiment, the face plate legs 28 are affixed to the lower side 38 of the face plate 20 at its ends 40 and 42. However, it is also contemplated that the face plate legs 28 be affixed to the face plate 20 at any convenient location.

Figure 3:
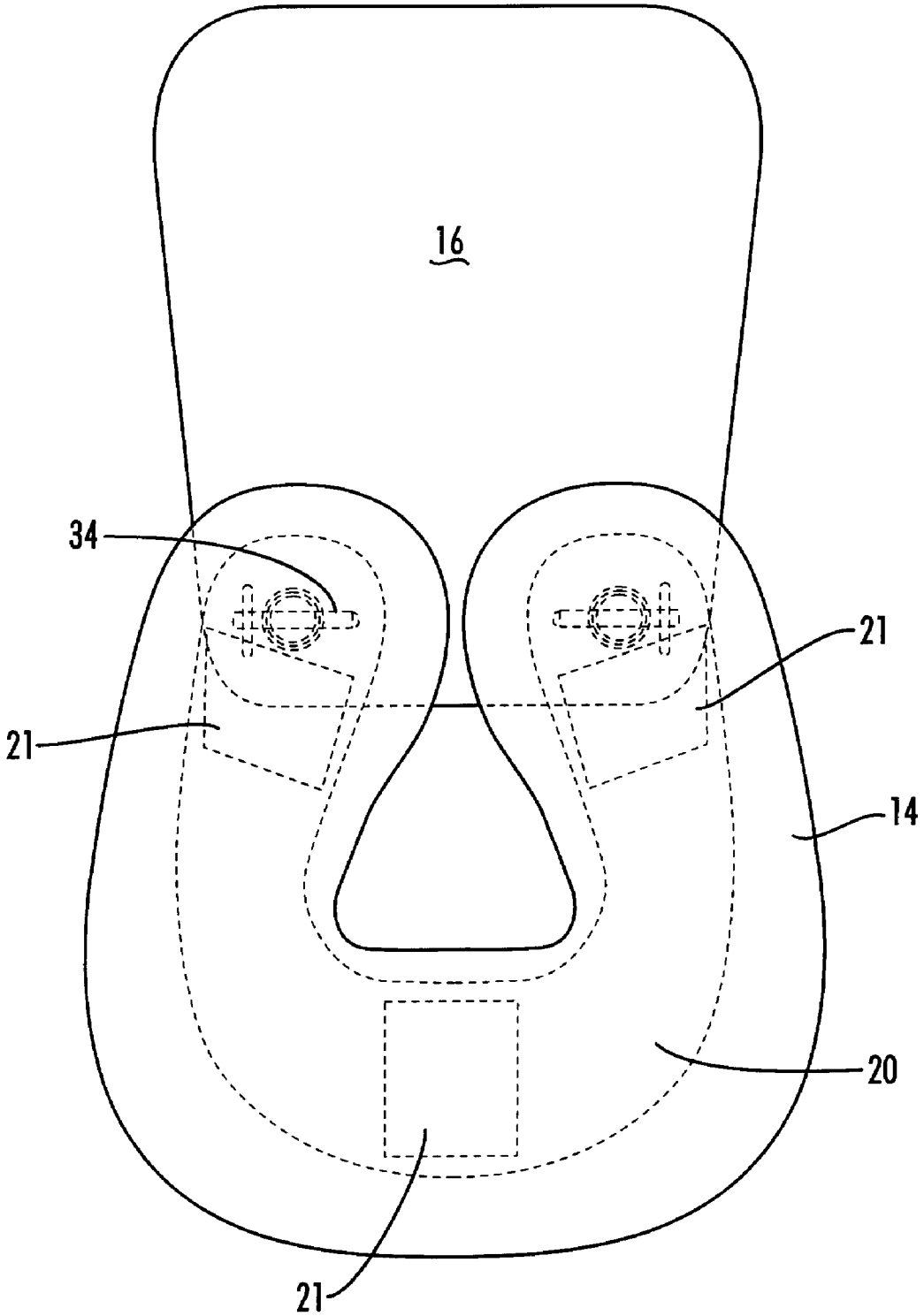
FIG. 3 is a top view of the embodiment of the invention shown in FIG. 1.

With reference to FIGS. 1 and 2, the cushion means 14 comprises a horseshoe-shaped cushion or pillow. However, the cushion means 14 may be configured in any desirable shape and contoured to provide maximum comfort. Thus, the cushion means 14 may comprise a plurality of separate cushions or pads, each of which is ergonomically configured to achieve the most comfortable position for a patient's head and/or face. The cushion means 14 is preferably attached to the face plate 20 by a fastening system 21, such as hook and loop material, that will enable the cushion means 14 to be removed. Accordingly, the hook (or loop) material is adhesively attached to the face plate 20, and the cooperative loop (or hook) material is affixed to an underside of the cushion means 14 (see FIGS. 3, 4 and 5).

Thus, although there have been described particular embodiments of the present invention of a new and useful head support apparatus, it is not intended that such references be construed as limitations upon the scope of this invention except as set forth in the following claims.

What is claimed is:

1. An apparatus for supporting a head of a user while said user lies on an upper surface of a workpiece having a pair of vertically stacked support surfaces, said apparatus comprising:

a. a workpiece having a pair of vertically stacked support surfaces, wherein said user lies on an upper surface of said workpiece;

b. a base having a front portion with at least one upright leg affixed thereto and a rear portion, said rear portion of said base received between the vertically stacked support surfaces;

c. a face plate supported by the at least one upright leg, wherein said face plate is cantilevered beyond said base and said leg is of sufficient height to position said face plate in association with said upper surface; and d. a cushion attached to the face plate, wherein the face plate and the cushion are substantially horseshoe-shaped.

2. The apparatus of claim 1, wherein the face plate and the cushion are configured to enable unrestricted airflow to a nose and a mouth of said user.

3. The apparatus of claim 1, further comprising:

a. means for adjusting the vertical height of the at least one leg.

4. The apparatus of claim 3, wherein the means for adjustment comprises:

a. at least one pair of telescoping columns for enabling vertical height adjustment of the apparatus; and b. means for securing the columns at any of a plurality of user-selectable positions.

5. The apparatus of claim 4, wherein the means for securing further comprises:

a. at least one pair of opposing bores formed in each of the columns; and b. a pin insertable through the bores formed in the columns when the bores of each column are aligned at a predetermined height.

6. The apparatus of claim 1, further comprising:

a. means for removably attaching the cushion to the face plate.

7. The apparatus of claim 6, wherein the attachment means comprises:

a. hook and loop material.

8. The apparatus of claim 1, wherein the at least one leg further comprises:

a. a pair of legs.

9. An apparatus for supporting the head during massage therapy on support surface, said apparatus comprising:

a. a base plate having at least one upright leg affixed thereto, wherein the legs are configured to enable vertical height adjustment of the apparatus, said base plate receivable under said support surface;

b. a face plate affixed to the at least one upright leg, the face plate is cantilevered beyond the base and wherein said legs are of sufficient height to position said face plate in association with said upper surface;

c. a cushion attached to the face plate, wherein the face plate and the cushion are substantially horseshoe-shaped; and wherein the base plate is adapted to be inserted between two support surfaces, and d. means for adjusting the vertical height of the at least one leg, wherein the means for adjustment includes at least one pair of telescoping columns for enabling vertical height adjustment of the apparatus; and means for securing the columns at any of a plurality of user-selectable positions.

10. The apparatus of claim 9, wherein the at least one upright leg further comprises:

a pair of telescoping columns, including a first column affixed to the base plate and a second column affixed to the face plate; and means for retaining the columns at a predetermined height.

11. The apparatus of claim 9, wherein the at least one leg further comprises:

a pair of legs.

12. An apparatus for supporting the head when a person is lying in a prone or supine position on an upper surface of a workpiece, comprising:

a. a base having at least one upstanding leg supporting a face plate, wherein said base may be partially inserted under said workpiece, the face plate is cantilevered beyond the base and said leg is of sufficient height to position said face plate in association with said upper surface;

b. a cushion attached to the face plate, wherein the face plate and the cushion are substantially horseshoe-shaped and configured to enable unrestricted airflow to the nose and mouth of a person whose head is positioned thereon, and c. means for adjusting the vertical height of the at least one leg, wherein the means for adjustment includes at least one pair of telescoping columns for enabling vertical height adjustment of the apparatus; and means for securing the columns at any of a plurality of user-selectable positions.

13. The apparatus of claim 12, further comprising:

means for adjusting the vertical height of the at least one leg.

14. The apparatus of claim 13, wherein the adjustment means comprises:

a. a pair of columns, one column being mounted to the base and one column being mounted to the face plate;

b. wherein the diameter of one column is smaller than the diameter of the other column such that the smaller diameter column is slidably insertable into the larger diameter column;

c. wherein the larger diameter column includes a plurality of bores, each being configured to receive a button positioned on the smaller diameter column;

d. wherein the button is biased to protrude from any of the plurality of bores when aligned therewith to anchor the column at a user-selectable height; and e. wherein the button may depressed to enable the slidable adjustment of the columns.

* * * * *